US007773105B2

(12) United States Patent
Yamada

(10) Patent No.: US 7,773,105 B2
(45) Date of Patent: Aug. 10, 2010

(54) DISPLAY METHOD, DISPLAY DEVICE, AND ELECTRONIC APPARATUS

(75) Inventor: Tadashi Yamada, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 867 days.

(21) Appl. No.: 11/537,263

(22) Filed: Sep. 29, 2006

(65) Prior Publication Data

US 2007/0091032 A1 Apr. 26, 2007

(30) Foreign Application Priority Data

Sep. 30, 2005 (JP) ..... 2005-287106
Mar. 10, 2006 (JP) ..... 2006-065210

(51) Int. Cl.
*G09G 5/10* (2006.01)

(52) U.S. Cl. ..... 345/690; 345/207

(58) Field of Classification Search ..... 345/207, 345/690

See application file for complete search history.

(56) References Cited

U.S. PATENT DOCUMENTS 5,929,845 A * 7/1999 Wei et al. ..... 345/156
6,320,325 B1 * 11/2001 Cok et al. ..... 315/169.3
7,008,795 B2 * 3/2006 Yerazunis et al. ..... 436/164
7,348,946 B2 * 3/2008 Booth et al. ..... 345/82
2003/0063081 A1 * 4/2003 Kimura et al. ..... 345/211
2005/0030256 A1 * 2/2005 Tubidis et al. ..... 345/30
2006/0055631 A1 * 3/2006 Yoshida ..... 345/46

FOREIGN PATENT DOCUMENTS

JP A-10-319910 12/1998
JP A-2001-035655 2/2001
JP A-2005-308775 11/2005
JP A-2006-106294 4/2006

* cited by examiner

*Primary Examiner*—Amare Mengistu
*Assistant Examiner*—Dmitriy Bolotin
(74) *Attorney, Agent, or Firm*—Oliff & Berridge, PLC

(57) ABSTRACT

A display method and a display device capable of performing light emission control without the need for an external light sensor are provided. The display device uses the display pixel to detect the external light. A panel drive current that is a sum of drive currents flowing into the red, green and blue pixels is detected. The panel drive current and a set current value that has been previously set are compared with each other. When the panel drive current is equal to or higher than the set current in a standard luminance display mode, the standard luminance display mode is switched to a high luminance display mode. When the panel drive current is lower than the set current value, the high luminance display mode is switched to the standard luminance display mode.

12 Claims, 7 Drawing Sheets

DISPLAY METHOD, DISPLAY DEVICE, AND ELECTRONIC APPARATUS

TECHNICAL FIELD

The present invention relates to a display method, a display device, and an electronic apparatus.

BACKGROUND ART

Up to now, there is proposed an organic electroluminescence display device (hereinafter, referred to as "organic EL display device") in which a light emitting element formed in a display area is constructed of an organic electroluminescence element (hereinafter, referred to as "organic EL element"). The organic EL display device of this kind attracts attention in terms of weight saving, high luminance, wide view angle, and the like.

However, the organic EL display device suffers reduction in display contract when strong outside light such as sunlight enters the display area, and as a result there is a problem in that the display area is difficult to be viewed.

Therefore, in order to solve the above-mentioned problem, by providing the display area with a luminance sensor, a luminance of light entering the display area (outside light) is measured while using this sensor. Accordingly, an organic EL display device is proposed which performs a light emission intensity control on the organic EL element with a luminance corrected on the basis of the result, in other words, in such a manner that light is emitted at a high luminance in a bright place and light is emitted at not too high luminance in a dark place (for example, refer to Patent Document 1). Then, in the above-mentioned organic EL display device, a luminance sensor is constructed of the organic EL element similarly to an organic EL element for performing image display and fabricated at the same time when the organic EL element for performing image display is formed. As a result, a display device capable of performing light emission intensity control without externally attaching the luminance sensor is realized.

[Patent Document 1] Japanese Unexamined Patent Application Publication No. 2001-35655

DISCLOSURE OF THE INVENTION

Problems to be Solved by the Invention

However, according to the organic EL display device described in Patent Document 1, provision of the luminance sensor is necessary, and for this reason there is a problem in that miniaturization and weight saving of the display device are hindered and the freedom of layout is restricted. In addition, in a large display area, the detection result of the detected luminance varies depending on the arrangement position of the luminance sensor. Thus, there are some cases where an appropriate light emission intensity control cannot be performed. Furthermore, an element characteristic of the organic EL element constructing the luminance sensor is different from that of the organic EL element for performing image display, and therefore an appropriate light emission intensity control cannot be performed sometimes.

The present invention has been made in view of the above-mentioned problems, and it is therefore an object to provide a display method and a display device which can perform an appropriate light emission intensity control without the provision of an external sensor.

Means for Solving the Problems

A display method of displaying on the basis of image data a first image on a display area where pixels are arranged on matrix including light emitting devices located at positions corresponding to intersections of a plurality of scanning lines and a plurality of data lines on a substrate by appropriately driving the respective pixels according to an aspect of the present invention includes: detecting a drive current of the respective pixels; comparing a current value of the drive current of the respective pixels to a set value that is previously set; and switching on the basis of the result, an image between the first image and a second image that is different from the first image being displayed to be displayed on the display area.

With the above-mentioned construction, a desired image is appropriately displayed in accordance with a change in drive current flowing into each light emitting element. For example, when the light emitting element is an electroluminescence element, if light with a wavelength corresponding to its energy gap enters, light excitation is occurred, whereby an electromotive force is generated in the respective light emitting elements. Therefore, while the first image is displayed, when light including light with the wavelength corresponding to the energy gap of the respective light emitting devices enters the display area, the electromotive force due to the light excitation is generated, whereby the drive current of the respective pixels varies. In view of the above, according to the present invention, the drive current supplied to the respective pixels is detected, and if the light enters the display area, the drive current flowing into the entire display area detected by the above-mentioned light excitation is high while the first image is displayed. For instance, a second image is displayed while the light emitting element of the respective pixels emits light at a high luminance. As a result, even when the light enters the display area, the light emitting element of the respective pixels emit light at a high luminance, whereby the contract becomes high and accordingly visibility can be improved.

In addition, as whether or not light enters the display area is determined by using the light emitting device for performing image display itself, provision of an external luminance sensor is unnecessary. Thus, miniaturization and weight saving of the display device are not hindered and the freedom of layout is not restricted. Furthermore, the light emitting device for performing image display itself is used, and therefore even when a large display area is involved, the arrangement position of the luminance sensor does not vary the detection result on the detected luminance. In addition, as the element characteristic of the light emitting device constructing the luminance sensor is not different from that of the light emitting device for displaying the image, appropriate light emission intensity control can be performed.

According to the display method, the first image is a standard luminance image, the second image is a high luminance image in which the respective light emitting devices have a higher luminance for light emission as compared with the luminance during the display of the standard luminance image, and when the drive current of the pixel by the standard luminance image becomes higher than a previously set value as an outside light enters the display area, the image may be switched from the standard luminance image to the high luminance image to be displayed on the display area.

With the above-mentioned construction, when light enters the display area, the light emitting element of each pixel is caused to emit light at a high luminance, whereby the contract becomes high and accordingly visibility can be improved.

According to this display method, when a drive current consumed by the standard luminance image is higher than a previously set value, by supplying high luminance image data for causing the light emitting devices to emit light with a higher luminance as compared with the case of using the image data, the image may be switched from the standard luminance image to the high luminance image to be displayed on the display area.

With the above-mentioned construction, for example, in a display device including data signal supply means for outputting a data signal to each pixel, a reference voltage with respect to the data signal output from the data signal supply means is controlled in accordance with a drive current supplied to each pixel, whereby it is possible to perform the light emission intensity control.

According to this display method, the image data may be image data for displaying a still image on the display area.

With the above-mentioned construction, as an image displayed on the display area is a still image and the variation in drive current caused by the light emission by itself is small, the erroneous light emission intensity control is not performed. As a result, appropriate light emission intensity control can be performed.

According to this display method, the display device is a car use display device and the standard luminance image may be a meter image.

With the above-mentioned construction, in a car use display device, there are some cases in which strong outside light enters the display area. However, in such cases, the contrast of the meter image to be displayed is enhanced, thereby improving the visibility of the meter image.

A display device for displaying on the basis of image data a first image on a display area where pixels are arranged on matrix including light emitting devices located at positions corresponding to intersections of a plurality of scanning lines and a plurality of data lines on a substrate by appropriately driving the respective pixels according to another aspect of the present invention, includes: drive current detection means for detecting a drive current of the pixel; luminance control means for generating and outputting a first luminance control signal for causing the respective light emitting devices to emit light with a first luminance to display the first image and a second luminance control signal for causing the respective light emitting devices to emit light with a luminance different from a luminance during the display of the first image; comparison means for comparing the detected drive current with a set value that is previously set; and control means for outputting on the basis of the comparison result between the detected drive current and the previous set value, one of the first luminance control signal and the second luminance control signal.

With the above-mentioned construction, a desired image is appropriately displayed in accordance with a change in drive current flowing into each light emitting element. For example, when the light emitting element is an electroluminescence element, if light with a wavelength corresponding to its energy gap enters, light excitation is occurred, whereby an electromotive force is generated in the respective light emitting elements. Therefore, while the first image is displayed, when light including light with the wavelength corresponding to the energy gap of the respective light emitting devices enters the display area, the electromotive force due to the light excitation is generated, whereby the drive current of the respective pixels varies. In view of the above, according to the present invention, the drive current supplied to the respective pixels is detected, and if the light enters the display area, the drive current flowing into the entire display area detected by the above-mentioned light excitation is high while the first image is displayed. For instance, a second image is displayed while the light emitting element of the respective pixels emits light at a high luminance. As a result, even when the light enters the display area, the light emitting element of the respective pixels emit light at a high luminance, whereby the contract becomes high and accordingly visibility can be improved.

In addition, as whether or not light enters the display area is determined by using the light emitting device for performing image display itself, provision of an external luminance sensor is unnecessary. Thus, miniaturization and weight saving of the display device are not hindered and the freedom of layout is not restricted. Furthermore, the light emitting device for performing image display itself is used, and therefore even when a large display area is involved, the arrangement position of the luminance sensor does not vary the detection result on the detected luminance. In addition, as the element characteristic of the light emitting device constructing the luminance sensor is not different from that of the light emitting device for displaying the image, appropriate light emission intensity control can be performed.

According to this display device, the drive current detection means may detect a drive current of the pixel caused when an outside light enters the display area.

With the above-mentioned construction, the image contrast is adjusted on the basis of the intensity of light entering the display area, and thus the visibility can be improved.

According to this display device, the luminance control means is data signal supply means for generating and outputting a data signal to be supplied to the respective pixels on the basis of the image data, and the data signal supply means may output, when the drive current consumed by the first image is equal to or higher than the set value, the second luminance control signal as high luminance image data for causing the light emitting device to emit light with a luminance higher than the luminance of the first image.

With the above-mentioned construction, the reference voltage with respect to the data signal output from the data signal supply means is controlled in accordance with the drive current supplied to each pixel, whereby it is possible to perform the light emission intensity control.

According to this display device, the display device is a car use display device and the first image may be a meter image.

With the above-mentioned construction, in a car use display device, although there are some cases in which strong outside light enters the display area, even in such cases, the contrast in the displayed meter image is enhanced, thereby improving the visibility of the meter image.

According to this display device, the light emitting device may include an electroluminescence element.

With the above-mentioned construction, when the electroluminescence element is irradiated with light, light excitation is generated and the drive current is varied. On the basis of the variation in the drive current caused by this light excitation, it is possible to perform the light emission intensity control.

According to this display device, the electroluminescence element may include an organic electroluminescence element.

With the above-mentioned construction, in the display device having the organic electroluminescence element, without provision of an external luminance sensor, it is possible to realize a display device capable of performing the appropriate light emission intensity control.

An electronic apparatus according to still another aspect of the present invention includes the display device described above.

With the above-mentioned construction, even when the outside light enters the display area, it is possible to provide an electronic apparatus including a display device capable of displaying an image superior in visibility without reduction in contrast.

BEST MODE FOR CARRYING OUT THE INVENTION

Hereinafter, embodiments in which a display device according to the present invention is realized as a car use display device will be described with reference to the drawings.

First Embodiment

A display device according to a first embodiment will be described with reference to FIGS. 1 to 7.

As shown in FIG. 1, a car use display device according to this embodiment (simply referred to as "display device") 1 is mounted on an instrument panel Qw functioning as an electronic apparatus of a car C. The display device 1 displays an image G of a speed meter on a display area Z thereof as a meter image indicating a speed of the car C.

The image G of the speed meter displayed on the display area Z is switched between a first image to be displayed at a standard luminance of a first luminance in a standard luminance display mode (standard luminance image) and a second image to be displayed at a higher luminance of a second luminance as a whole in a high luminance display mode compared to the standard luminance display mode (high luminance image).

FIG. 2 shows a display mode of the image G of the speed meter to be displayed in each mode. In FIG. 2, in the image G of the speed meter, numerals Ma indicating a speed of the car C of "0", "20", "40", . . . , "160" are displayed at predetermined intervals. Then, a pointer Mb is displayed at a position surrounded by the numerals Ma. The pointer Mb marks a speed of the car at this moment while being turned about a base end section Mc thereof in accordance with the speed of the car C for display.

FIG. 3 is an explanatory diagram of an electrical construction of the display device 1. As shown in FIG. 3, the display device 1 is constructed by a display unit 2 and a control unit 3. The display unit 2 includes the substantially rectangular display area Z in the center of a substrate 4*a*. An area other than the display area Z on the substrate 4*a* (hereinafter, referred to as "non-display area") has a pair of scanning line driver circuits 5. In addition, a flexible print circuit board 4*b* connected to the substrate 4*a* via an anisotropic conductive film (ACF) is provided on a lower side of the substrate 4*a*. A data line driver circuit 11 functioning as control means is mounted to the flexible print circuit board 4*b*.

As shown in FIG. 4, the display area Z is provided with n scanning lines LY1, LY2, . . . , LYn extending along one direction and m data lines LX1, Lx2, . . . , LXm−1, LXm extending so as to be perpendicular to the respective scanning lines LY1 to LYn. In addition, at positions corresponding to intersections between the scanning lines LY1 to LYn and the data lines LX1 to LXm, pixels 8R, 8G, and 8B for red, green, and blue are formed.

Also, on the display area Z, m power source lines Lo are provided so as to extend in parallel to the data lines LX1 to LXm. The power source lines Lo extending in parallel to the data lines LX1, LX4, . . . are connected to the red pixels 8R, the power source lines Lo extending in parallel to the data lines LX2, . . . , LXm−1 are connected to the green pixels 8G, and the power source lines Lo extending in parallel to the data lines LX3, . . . , LXm are connected to the red pixels 8B.

As shown in FIG. 5, each of the red pixels 8R has an organic EL element 9R for red as a light emitting element, a switching element Sw, a holding capacitor Co, and a drive transistor Qd. The red color organic EL element 9R is an organic electroluminescence element whose light emitting layer (not shown in the drawing) is composed of an organic material, and in this embodiment, the light emitting layer is composed of a known organic light emitting material of polyfluorene or polyphenylene vinylene.

Each of the switching element Sw is, for example, a transistor whose conductive type is N. The respective gates are connected to the scanning lines LY1, LY2, . . . extending at corresponding positions, the respective drains are connected to the data lines LX1, LX4, . . . extending at corresponding positions, and the respective sources are connected to one of electrodes of the holding capacitors Co. In addition, in the holding capacitors Co, the gates of the drive transistor Qd are connected to the one of electrodes, and the power source lines Lo are connected to the other electrodes. It should be noted that as shown in FIG. 5, the circuit structures of the green pixel 8G and the blue pixel 8B are the same as that of the red pixel 8R, and the detailed description will be omitted for the green pixel 8G and the blue pixel 8B while keeping the same reference numerals.

Then, as shown in FIG. 4, the pixels 8R, 8G, and 8B for red, green, and blue are arranged along the scanning lines LY1 to LYn in the order of the red pixel 8R→the green pixel 8G→the blue pixel 8B→the red pixel 8R→ . . . →the blue pixel 8B. In addition, along the data lines LX1 to LXm, the same color pixels are arranged. Then, the three pixels of the red pixel 8R, the green pixel 8G, and the blue pixel 8B which are arranged adjacent to one another form one color pixel 8.

It should be noted that each of the organic EL elements 9R, 9G, and 9B absorbs light at a wavelength corresponding to the energy gap of the light emitting layer when outside light (natural light) with a predetermined intensity or higher enters the display area Z among a plurality of wavelengths that form the light, and as a result, through the light emitting layer, an electromotive force is generated due to light excitation in the respective organic EL elements 9R, 9G, and 9B.

For example, in the case where the light emitting layer is composed of a known organic light emitting material of polyfluorene or polyphenylene vinylene, with the irradiation of outside light (natural light) whose intensity is about 3,000 [1×] or higher, light at a wavelength of about 400 nm among them is absorbed, and an electromotive force due to light excitation is generated between the anode and the cathode of the respective organic EL elements 9R, 9G, and 9B.

FIG. 6 is a graph showing an experiment result on the electromotive force due to light excitation of each of the organic EL elements 9R, 9G, and 9B. As shown in FIG. 6, it is understood that a current (drive current) Id flowing between the anode and the cathode of the respective organic EL elements 9R, 9G, and 9B is almost constant during the irradiation of outside light (natural light) with an intensity of lower than about 3,000 [1×] but is sharply increased during the irradiation with an intensity of about 3,000 [1×] or higher.

As shown in FIG. 3, the scanning line driver circuits 5 are formed as a pair on the right and left sides so as to sandwich the display area Z on the non-display area. The scanning line driver circuits 5 are respectively connected to the scanning lines LY1 to LYn. As shown in FIG. 4, the scanning line driver circuits 5 respectively output scanning signals SC1, SC2, SC3, . . . SCn for selecting one desired column group of the color pixels 8 among the color pixels 8 in the n columns to the scanning lines LY1 to LYn in sync. For example, the scanning signals SC1 to SCn are output to the scanning lines LY1 to Lyn in the order of the first scanning line LY1→the second scanning line LY2→the third scanning line LY3→ . . . →the n-th scanning line LYn→the first scanning line LY1→ . . . , thereby selecting the color pixels 8 in each column in sequence.

The data line driver circuit 11 includes, as shown in FIG. 4, m digital/analog conversion circuits D1, D2, D3, . . . , Dm−1, and Dm respectively corresponding to the data lines LX1 to LXm. The digital/analog conversion circuits D1 to Dm are known digital/analog conversion circuits which convert image data GD for forming the image G of the speed meter at each moment that is output from the control unit 3 into data signals respectively having a size corresponding to a reference voltage Vk and output the data signals to the corresponding data lines LX1 to LXm.

The reference voltage Vk is one of two kinds of reference voltages, and in this embodiment, a standard luminance reference voltage Vkl and a high luminance reference voltage Vkh higher than the reference voltage Vkl, one of which is selected and input from the control unit 3. The standard luminance reference voltage Vkl is a reference voltage for displaying the image G of the speed meter in a standard luminance display mode. The high luminance reference voltage Vkh is a reference voltage for displaying the image in a high luminance display mode.

Then, the data line driver circuit 11 varies, when a data signal is generated and output from the input image data GD to the respective data lines LX1 to LXm, depending on whether the data signal level is the standard luminance reference voltage Vkl or the high luminance reference voltage Vkh. In other words, when the high luminance reference voltage Vkh is input, the data signal level with respect to the image data GD is higher than the level of the standard luminance reference voltage Vkl during the generation. Therefore, even when the image data GD is the same, the light emission luminance of the organic EL elements 9R, 9G, and 9B on the basis of the data signal generated in the case of the high luminance reference voltage Vkh is higher than that of the organic EL elements 9R, 9G, and 9B on the basis of the data signal generated in the case of the standard luminance reference voltage Vkl.

The data signal generated on the basis of the standard luminance reference voltage Vkl (the standard luminance display mode) is referred to as standard luminance image data (standard luminance control signal), and the data signal generated on the basis of the high luminance reference voltage Vkh (the high luminance display mode) is referred to as high luminance image data (high luminance control signal). Therefore, in the case of the high luminance display mode, the image G of the speed meter displayed on the display area Z is displayed with a higher luminance than that in the case of the standard luminance display mode.

As shown in FIG. 3, the control unit 3 includes a logic system power source circuit 21, a panel power source circuit 22, a current detection circuit 23 as drive current detection means, an EEPROM 24, a reference voltage generation circuit 25 as luminance control means, a panel control circuit 26 as comparison means, and an image processing circuit 27 as data signal supply means.

The logic system power source circuit 21 and the panel power source circuit 22 are circuits adapted to generate, on the basis of a predetermined power source Fo supplied from an external power source circuit that is not shown, various power source voltages for driving the drive circuits 5 and 11 and the pixels 8R, 8G, and 8B provided on the display unit 2. The logic system power source circuit 21 generates, for example, on the basis of the power source Eo, the scanning line driver circuits 5, a power source voltage Vs at a level necessary for driving the data line driver circuit 11 to be output to the scanning line driver circuits 5 and the data line driver circuit 11. The panel power source circuit 22 generates a power source voltage Vo on the basis of the power source Eo to be output to the pixels 8R, 8G, and 8B via a power source lines Lo.

The current detection circuit 23 includes a resistance element 23*a* and an analog/digital conversion circuit (hereinafter, referred to as "A/D conversion circuit") 23*b*. A panel drive current In that is a sum of the drive currents Id flowing into all the pixels 8 (8R, 8G, 8B) that are output from the display unit 2 is input to the current detection circuit. Then, the current detection circuit 23 allows the panel drive current In to flow into the resistance element 23*a* and subjects an inter-terminal voltage of the resistance element 23*a* into the A/D conversion, thereby outputting a panel drive current value K of the panel drive current In.

The EEPROM 24 stores a set current value Is as a set value in advance. The set current value Is according to this embodiment is a value corresponding to a magnitude of the panel drive current In (the panel drive current value K) that flows into the display area Z at the time of incidence of outside light at an intensity of about 3,000 [1×].

In other words, the image G of the speed meter is an image, as shown in FIG. 2, in which the numerical signs Ma and the base end section Mc are both fixed, that is, still images, and an image to be displayed when only the pointer Mb is turned, that is, a moving image. As the pointer Mb only turns about the base end section Mc, the display area of the pointer Mb (light emission area) is unchanged even when the pointer Mb is turned. Therefore, the sum of each luminance of all the color pixels 8 in the display area Z when the image G of the speed meter is displayed in the standard luminance display mode is substantially a constant value, and the panel drive current In at this time is a predictable standard value. Then, the predicted standard value in the standard luminance display mode with respect to the panel drive current In is set as the set current value Is.

The reference voltage generation circuit 25 is adapted to generate two types of reference voltages with different sizes to be supplied to the respective digital/analog conversion circuits D1 to Dm of the data line driver circuit 11 (the standard luminance reference voltage Vkl and the high luminance reference voltage Vkh which is larger than the standard luminance reference voltage Vkl). Then, the reference voltage generation circuit 25 selects, in accordance with selection signals SVl and SVh input from the panel control circuit 26, one of the standard luminance reference voltage Vkl and the high luminance reference voltage Vkh to be output to the respective digital/analog conversion circuits D1 to Dm.

The panel control circuit 26 generates, on the basis of a clock signal CLK supplied from the outside, timing signals Sa and Sb for performing synchronization control on the scanning line driver circuits 5 and the data line driver circuit 11 to be output to the respective driver circuits 5 and 11.

Also, the panel control circuit 26 reads out the set current value Is from the EEPROM 24. The panel control circuit 26 compares the read set current value Is with the panel drive current value K output from the current detection circuit 23. Then, the panel control circuit 26 recognize, when it is determined that the panel drive current value K is lower than the set current value Is, that the display area Z is incident with outside light with an intensity lower than about 3,000 [1×]. In this case, the standard luminance display mode is established, and the panel control circuit 26 is adapted to output the selection signal Svl to the reference voltage generation circuit 25 so that the standard luminance reference voltage Vkl is selected. As a result, the reference voltage generation circuit 25 generates the standard luminance reference voltage Vkl and outputs the signal to the data line driver circuit 11.

On the other hand, the panel control circuit 26 recognizes, when it is determined that the panel drive current value K is equal to or higher than the set current value Is, that the display area Z is incident with outside light with an intensity of about 3,000 [1×] or higher. In this case, the high luminance display mode is established, and the panel control circuit 26 is adapted to output the selection signal Svh to the reference voltage generation circuit 25 so that the high luminance reference voltage Vkh is selected. As a result, the reference voltage generation circuit 25 generates the high luminance reference voltage Vkh and outputs the signal to the data line driver circuit 11.

It should be noted that in this embodiment, at the time of turning on of power supply to the display device 1, the panel control circuit 26 is initially set in the standard luminance display mode, and previously set to output the selection signal Svl.

The image processing circuit 27 inputs the image data GD that is generated at an external image generation circuit not shown in the drawing. In this embodiment, the image data GD is input to the pointer Mb constructing the image G of the speed meter all the time, and the data is intermittently input to the numerical signs Ma and other fixed images (fixed patterns) at a predetermined timing.

Next, the action of the display device 1 constructed in the above-mentioned manner will be described with reference to FIG. 7.

When a drive key is inserted into a key cylinder at a driver seat and an engine is turned over, a power is supplied to the display device 1 (Step S1-1). At this time, for example, on the display unit 2, the standard luminance display mode is initially set, and the image G of the speed meter is displayed on the display area Z in the standard luminance mode.

After that, the panel drive current In is output to the current detection circuit 23 of the control unit 3. Then, the current detection circuit 23 detects a current value K of the panel drive current In to be output to the panel control circuit 26 (Step S1-2).

In response to this, the panel control circuit 26 compares the set current value Is stored in the EEPROM 24 with the panel drive current value K from the current detection circuit 23 (Step S1-3). When it is determined that the panel drive current value K is lower than the set current value Is (that is, in the case where the display area z is incident with outside light with an intensity lower than about 3,000 [1×]) (NO in Step S1-4), the standard luminance reference voltage Vkl is supplied from the reference voltage generation circuit 25 to the respective digital/analog conversion circuits D1 to Dm of the data line driver circuit 11 (Step S1-5).

Therefore, the image G of the speed meter is displayed on the display unit 2 in the standard luminance display mode. As a result, the light emission luminance of the image G of the speed meter is decreased, and it is possible to avoid such a situation that the image G is too bright to look at. In addition, the power consumption can be reduced.

Subsequently, it is checked whether or not the power supply to the display device 1 is turned off (Step S1-6), and when the power supply is still turned on (NO in Step S1-6), the resistance element 23*a* for the current detection of the current detection circuit 23 detects the panel drive current In again. On and after (Step S1-2), the operations in Step S1-2 to S1-5 are repeatedly performed, whereby the image G of the speed meter is displayed in the standard luminance display mode.

Over time, if the outside light entering the display area Z becomes more intense, the panel drive current In is increased, and accordingly the current value K is also increased. When the outside light has an intensity equal to higher than about 3,000 [1×], the panel control circuit 26 determines that the panel drive current value K is equal to higher than the set current value Is (YES in Step S1-4). Then, the panel control circuit 26 supplies the high luminance reference voltage Vkh from the reference voltage generation circuit 25 to the respective digital/analog conversion circuits D1 to Dm of the data line driver circuit 11 (Step S1-7).

After that, the image G of the speed meter is displayed on the display area Z while switching from the standard luminance display mode to the high luminance display mode. Therefore, when the outside light entering the display area z is equal to or higher than about 3,000 [1×], the light emission luminance of the organic EL elements 9R, 9G, and 9B is increased, and the image G of the speed meter displayed on the display area Z becomes easier to be looked at.

According to the above-mentioned embodiment, the following action effects can be attained.

(1) According to the above-mentioned embodiment, the panel drive current value K corresponding to the panel drive current In that is a sum of the drive currents flowing into the organic EL elements 9R, 9G, and 9B is detected, and the panel drive current value K is compared with the set current value Is that is set in advance. Then, in the standard luminance display mode, if the panel drive current value K is higher than the set current value Is, it is recognized that intense outside light enters the display area Z, and the standard luminance display mode is switched to the high luminance display mode. As a result, the contrast of the image G of the speed meter is increased. Also, the panel drive current value K and the set current value Is are compared with each other, and as a result, in the high luminance display mode, if the panel drive current value K is lower than the set current value Is, it is recognized that no intense outside light enters the display area Z, and the high luminance display mode is switched to the standard luminance display mode. As a result, the contrast of the image G of the speed meter is decreased.

Therefore, without any additional use of a special the luminance sensor, the contrast of the image G of the speed meter can be adjusted. As a result, it is possible to realize the display device 1 capable of performing the light emission intensity control without hindering the miniaturization and weight saving or the freedom of layout.

(2) According to the above-mentioned embodiment, on the basis of the panel drive current In due to the drive currents Id flowing into the organic EL elements 9R, 9G, and 9B themselves of the color pixel 8 contributing to the display, the standard luminance display mode and the high luminance display mode are switched over, and accordingly all the color pixels function as the luminance sensor in a manner. Therefore, even in the case of a large display device whose display area Z is large, as a detection result of the lighting intensity does not vary at any positions in the display area Z, appropriate light emission intensity control can be performed.

(3) According to the above-mentioned embodiment, the image G of the speed meter indicating a speed of the car C is displayed on the display area Z. Therefore, even if intense outside light enters the display area Z, it is possible to avoid such a situation in advance that the image G of the speed meter becomes difficult to be looked at.

Second Embodiment

Next, a display device according to a second embodiment will be described with reference to FIGS. 8 and 9.

AS shown in FIG. 8, with a display device 1A according to this embodiment, the reference voltages Vko supplied to the digital/analog conversion circuits D1 to Dm of the data line driver circuit 11 are kept constant. In other words, the reference voltage Vko at a predetermined level are output from the reference voltage generation circuit 25.

Also, the panel control circuit 26 according to this embodiment is adapted to compare the set current value Is read from the EEPROM 24 with the panel drive current value K output from the current detection circuit 23 and output the result to the image processing circuit 27. In addition, the external image generation circuit for supplying the image data GD to the image processing circuit 27 prepares, in this embodiment, high luminance image data GD1 and standard luminance image data GD2. The high luminance image data GD1 is image data for an image that is designed to be easily visually recognized even when intense outside light enters the display area Z, and the standard luminance image data GD2 is image data for an image that is designed to be less easily visually recognized than the case of the high luminance image data GD1 when intense outside light enters the display area Z.

When a result that the panel drive current value K is equal to or higher than the set current value Is is input from the panel control circuit 26, the image processing circuit 27 outputs a request signal Sr to the external image generation circuit for requesting the high luminance image data GD1. On the other hand, when a result that the panel drive current value K is lower than the set current value Is is input from the panel control circuit 26, the image processing circuit 27 outputs the request signal Sr to the external image generation circuit for requesting the standard luminance image data GD2.

Next, the actions of the display device 1A constructed in the above-mentioned manner will be described with reference to FIG. 9.

When a drive key is inserted into a key cylinder at a driver seat and an engine is turned over, a power is supplied to the display device 1A (Step S2-1). Hereinafter, as in the first embodiment, the standard luminance display mode is initially set, and the image G of the speed meter is displayed on the display area z in the standard luminance mode. After that, the panel drive current In is output to the current detection circuit 23 of the control unit 3. In response to this, the current detection circuit 23 detects the current value K of the panel drive current In to be output to the panel control circuit 26 (Step S2-2).

Then, the panel control circuit 26 compares the set current value Is stored in the EEPROM 24 with the panel drive current value K from the current detection circuit 23 (Step S2-3). When it is determined that the panel drive current value K is lower than the set current value Is (that is, the case where outside light with an intensity lower than about 3,000 [1×] enters the display area Z) (NO in Step S2-4), that effect is output to the image processing circuit 27. In response to this, the image processing circuit 27 outputs the request signal Sr to the external image generation circuit for requesting the standard luminance image data GD2.

As a result, the external image generation circuit outputs the standard luminance image data GD2. Then, the image processing circuit 27 outputs the standard luminance image data GD2 to the data line driver circuit 11. Therefore, the standard luminance image is displayed on the display area Z (Step S2-5).

Subsequently, it is checked whether or not the power supply to the display device 1A is turned off (Step S2-6), and when the power supply is still turned on (NO in Step S2-6), the resistance element 23*a* of the current detection circuit 23 detects the panel drive current In again (Step S2-2), and on and after, the above-mentioned operations in Step S2-2 to S2-6 are repeatedly performed, whereby the standard luminance image continues to be displayed.

Over time, when the outside light entering the display area Z has an intensity equal to or higher than about 3,000 [1×], the panel drive current In is increased, and as a result, the panel drive current value K converted by the A/D conversion circuit 23*b* is also increased. Then, in the case where it is determined that the panel drive current value K is equal to or higher than the set current value Is (that is, the case where the display area Z is incident with outside light with an intensity equal to or higher than about 3,000 [1×]) (YES in Step S1-4), that effect is output to the image processing circuit 27. Then, the image processing circuit 27 outputs the request signal Sr to the external image generation circuit for requesting the high luminance image data GD1.

As a result, the external image generation circuit outputs the high luminance image data GD1. Then, the image processing circuit 27 outputs the high luminance image data GD1 to the data line driver circuit 11. Therefore, the high luminance image is displayed on the display area Z (Step S2-7).

According to the above-mentioned embodiment, the following action effects can be attained.

(1) According to the above-mentioned embodiment, the image processing circuit 27 is adapted to switch the image data GD1 for displaying the high luminance image and the image data GD2 for displaying the standard luminance image which are different in design and displayed on the display area Z in accordance with the size of the panel drive current In to be output to the data line driver circuit 11. Therefore, as in the first embodiment, it is possible to realize the display device capable of performing the light emission intensity control without additional use of a special luminance sensor.

It should be noted that this invention can also be implemented through modifications in the following manner.

According to the above-mentioned embodiments, the case had been described in which the panel drive current In changes depending on the outside light entering the display area Z, but the present invention is not limited to the above. The panel drive current In also changes due to change in the outside temperature and luminance degradation of the organic EL elements 9R, 9G, and 9B other than the outside light entering the display area Z, and therefore in the case of the change in the outside temperature and luminance degradation of the organic EL elements 9R, 9G, and 9B as well, images may be switched to an appropriate image by detecting the change in the panel drive current In. At this time, the outside temperature may be detected by a temperature sensor provided in the vicinity of the panel. Also, detection of the luminance degradation of the organic EL elements 9R, 9G, and 9B can be estimated by use of a count value of accumulated lighting time or the like.

According to the above-mentioned embodiments, when the drive key is inserted into the key cylinder at the driver seat and the engine is turned over to supply power to the display device 1, the image G of the speed meter is displayed on the display area Z in the standard luminance mode. This construction may be changed in such a manner. When power is supplied to the display device 1, the panel drive current In at this time is detected, and the panel drive current In at this time is set as the set current value Is. Then the switching over for the display of the image G of the speed meter from the standard luminance mode to the high luminance display mode may be performed. With this construction, the light emission intensity control on the image G of the speed meter immediately after the power supply start to the display device 1 may be conducted.

According to the above-mentioned embodiments, the digital/analog conversion circuits D1 to Dm are embodied, and the reference voltages Vk to be supplied to the digital/analog conversion circuits D1 to Dm are controlled. Then, the switch over between the standard luminance display mode and the high luminance display mode is performed to display the image G of the speed meter. This construction may be changed in such a manner. For example, luminance control means is set as the panel power source circuit 22 for supplying the power source voltage Vo, and the panel power source circuit 22 prepares the power source voltage Vo in two types: a standard luminance voltage and a high luminance voltage higher than the standard luminance voltage. Then, the panel control circuit 26 controls the panel power source circuit 22 instead of the reference voltage Vk and performs the switch over between the standard luminance voltage and the high luminance voltage to be supplied to the respective color pixels 8, making it possible to display the image G of the speed meter. With this construction as well, the same effects as described above can be obtained.

According to the above-mentioned embodiments, the display device 1 for displaying the speed meter indicating the speed of the car as the image G and the display method thereof have been described as an example, but a display device for displaying, other than the speed meter, a tachometer indicating the engine revolutions of the car C, a measuring instrument gauge (such as an indicator and a warning) and the like may be implemented.

According to the above-mentioned embodiments, only the numerical signs Ma and the pointer Mb are displayed in the image G of the speed meter displayed on the display area Z, but in addition to the numerical signs Ma and the pointer Mb, a break lamp and marks for various warnings may be displayed.

According to the above-mentioned embodiments, the display device 1 utilizing the organic EL elements 9R, 9G, and 9B is used as the light emitting element, but the present invention may also be applied to the case where the display device uses a light emitting device other than the organic EL elements 9R, 9G, and 9B. Above all, any light emitting device that absorbs light at a predetermined wavelength and generates an electromotive force due to the light excitation may be used.

According to the above-mentioned embodiments, the instrument panel Qw of the car C as an electronic device has been described, but the present invention is not limited to the above and may be widely applied to a measuring instrument gauge display device.

REFERENCE NUMERALS

Figure 1:
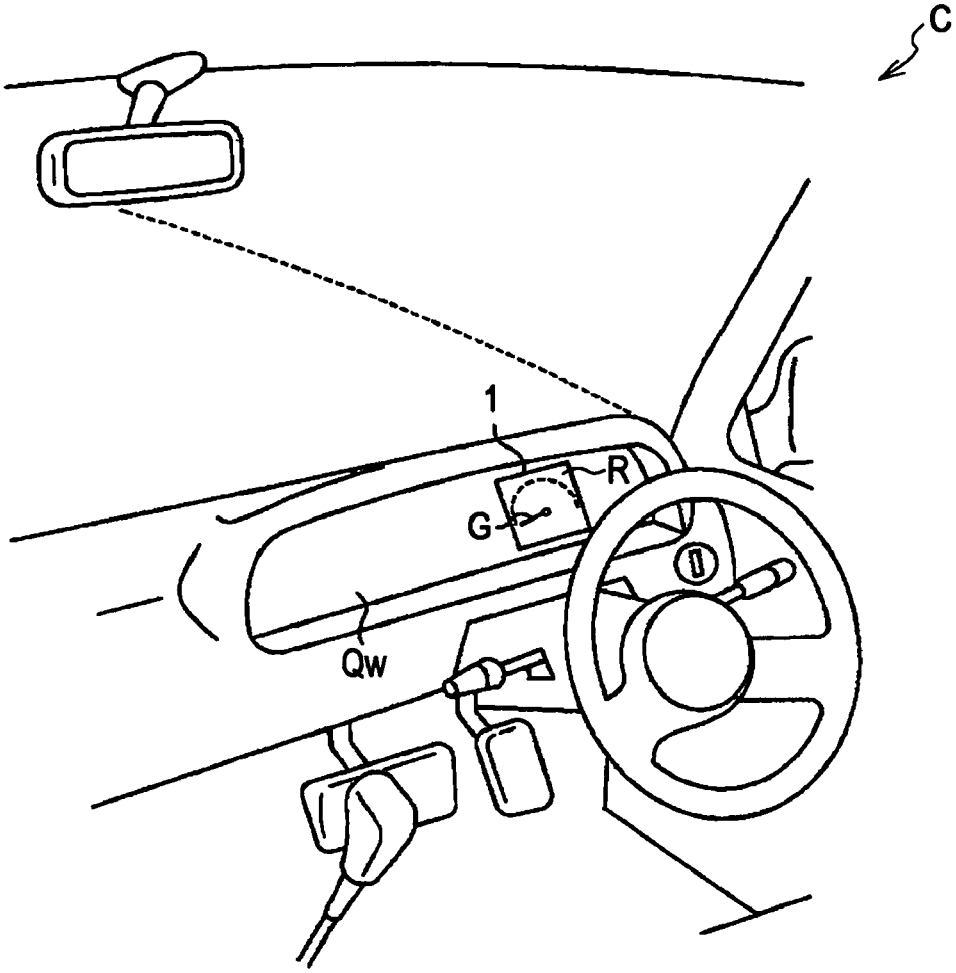
FIG. 1 A perspective view of a car instrument panel to which a display device is mounted.
Figure 2:
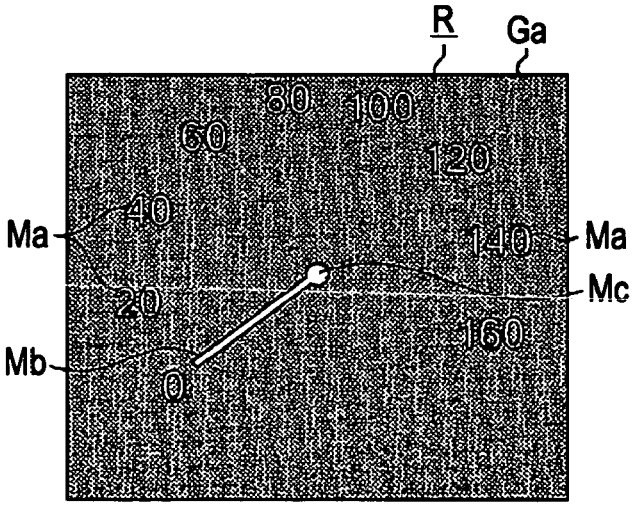
FIG. 2 A schematic diagram showing a display mode for a speed meter image.
Figure 3:
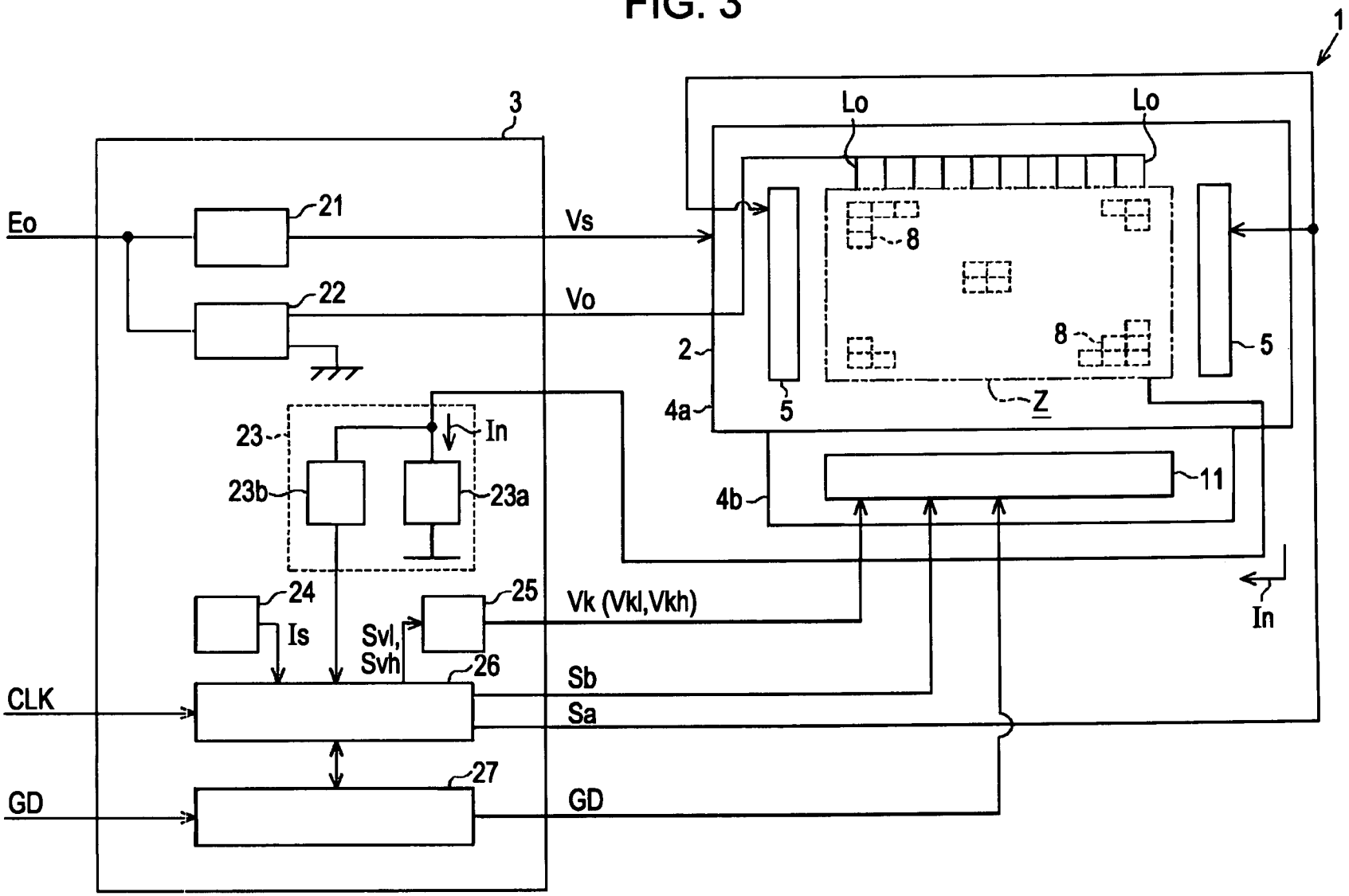
FIG. 3 A diagram showing an electrical construction of a display device according to a first embodiment.
Figure 4:
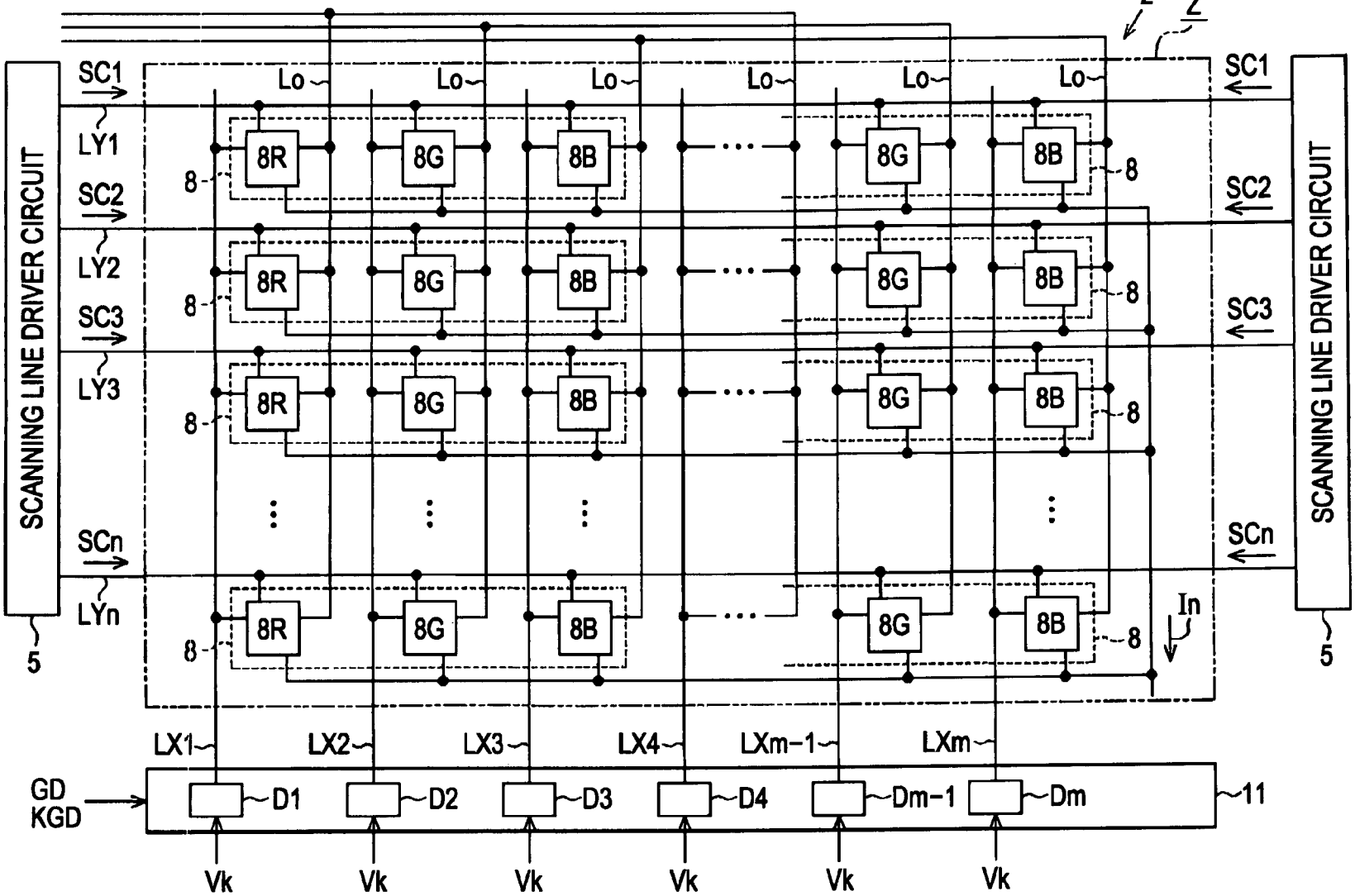
FIG. 4 A diagram showing an electrical construction of display unit.
Figure 5:
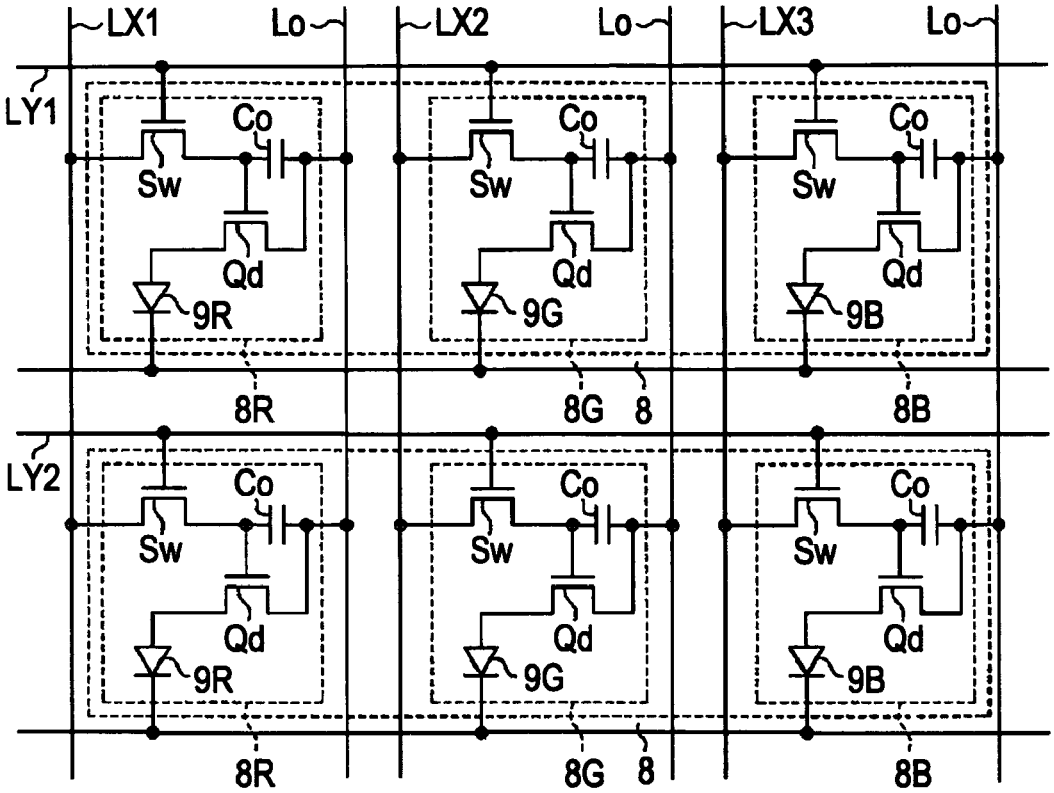
FIG. 5 A diagram showing an electrical construction of a pixel.
Figure 6:
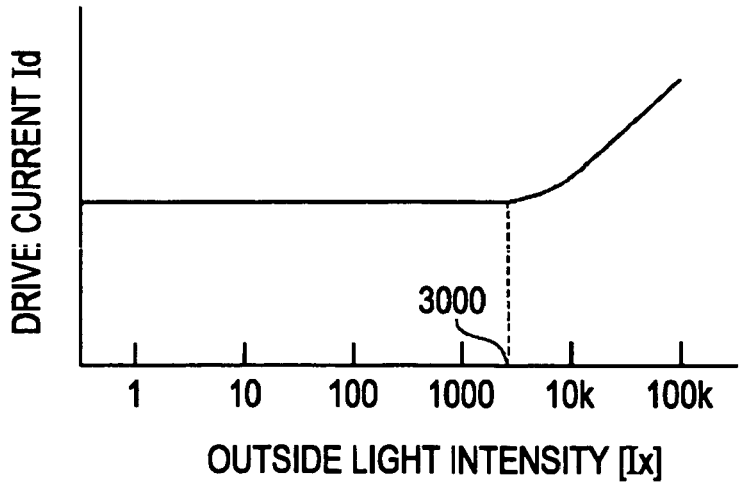
FIG. 6 A diagram showing a change in drive current due to light excitation of an organic electroluminescence element.
Figure 7:
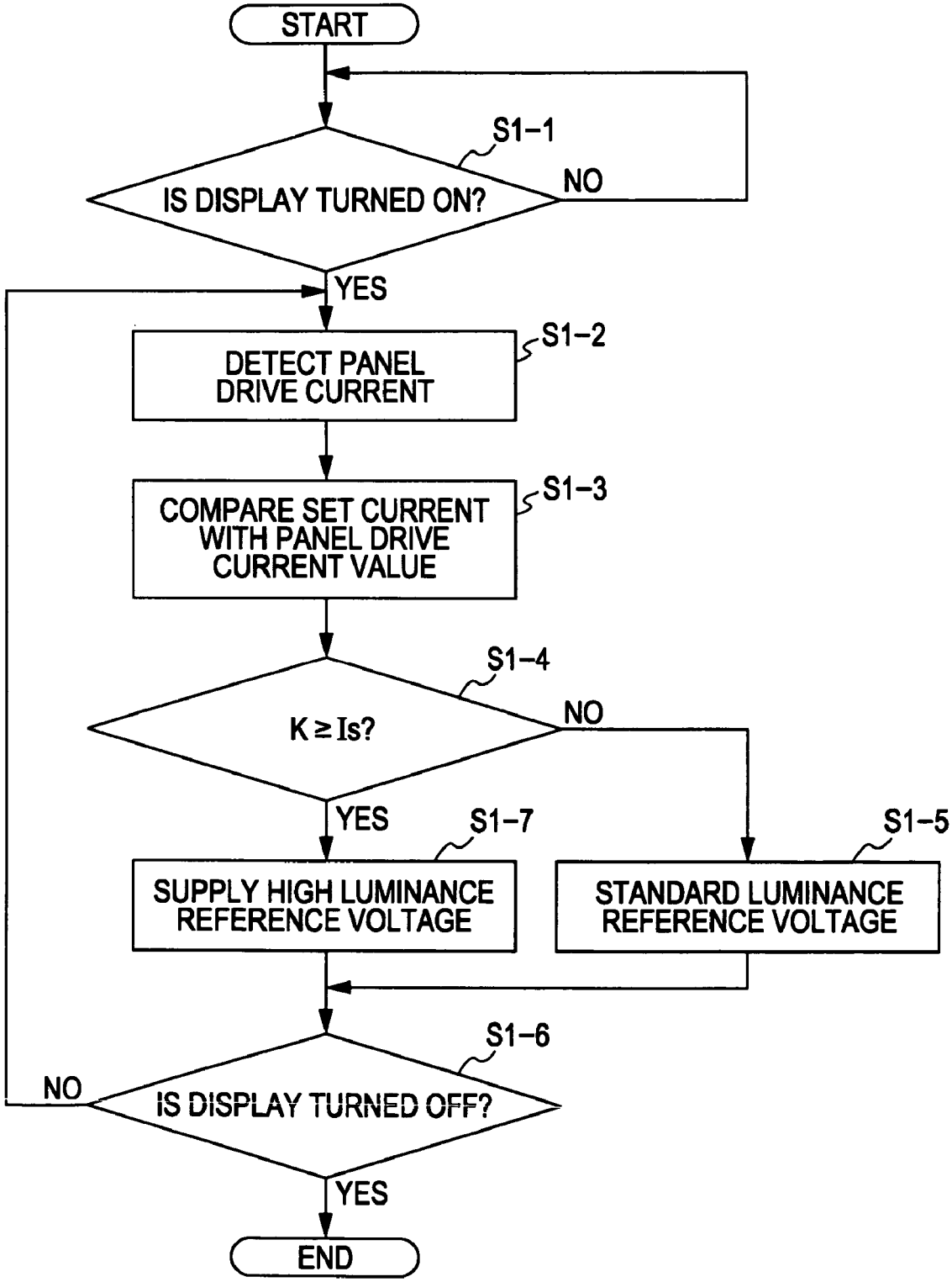
FIG. 7 A flowchart for describing an action of the display device according to the first embodiment.
Figure 8:
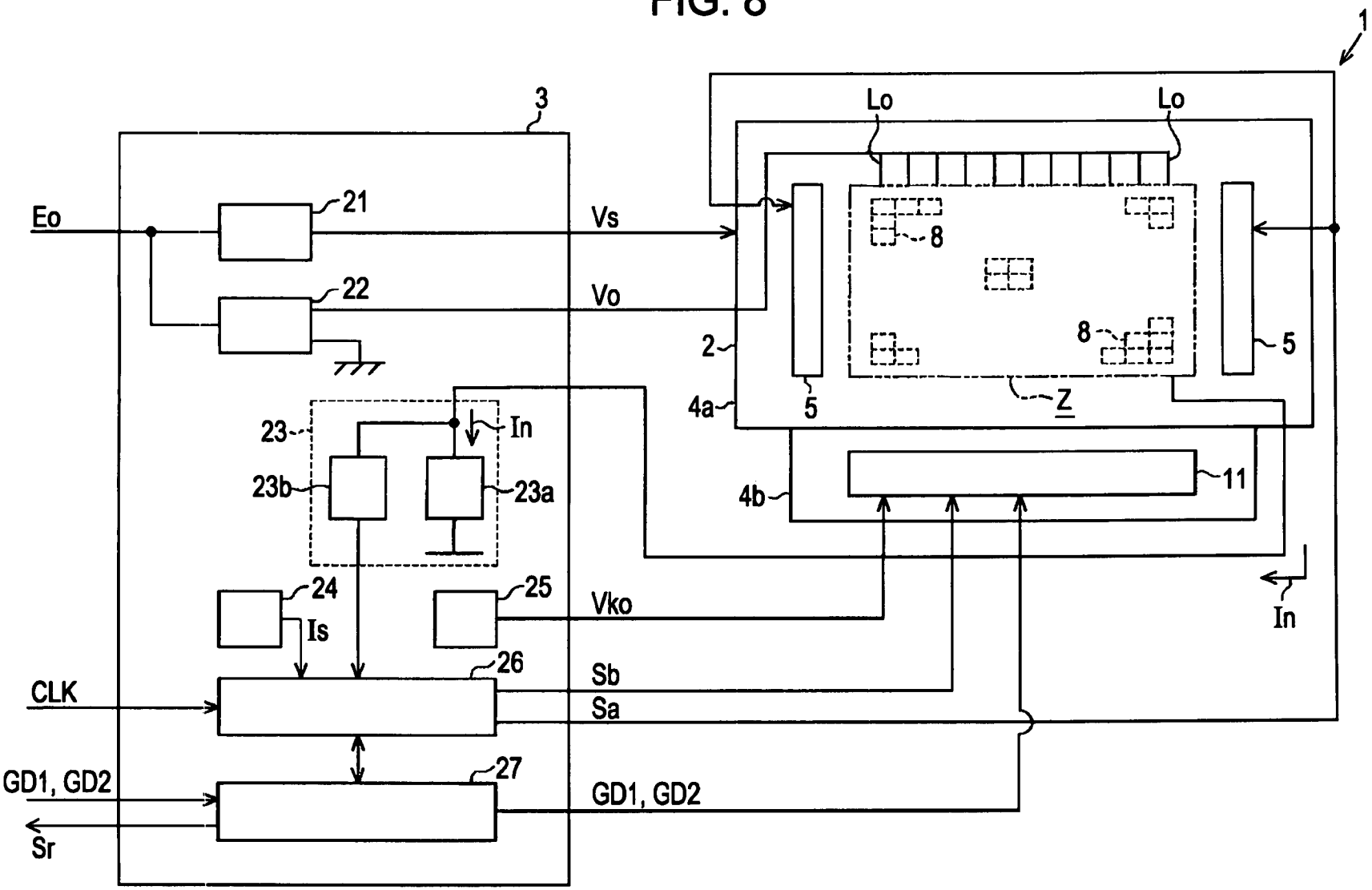
FIG. 8 A diagram showing an electrical construction of a display device according to a second embodiment.
Figure 9:
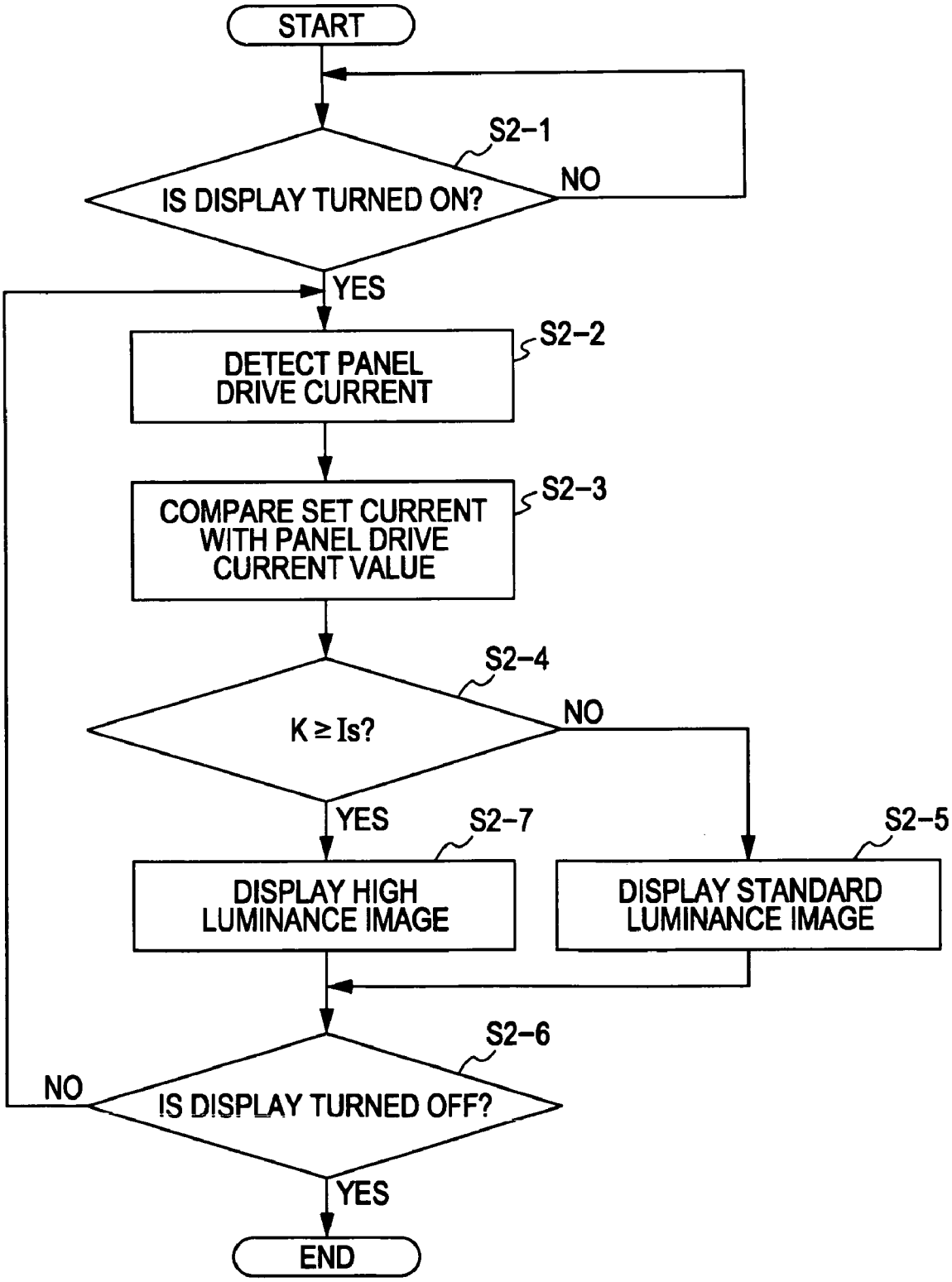
FIG. 9 A flowchart for describing an action of the display device according to the second embodiment.

G . . . speed meter image as meter image, In . . . panel drive current, Is . . . set current value as set value, LX1 to LXm . . . data line, LY1 to LYn . . . scanning line, Qw . . . instrument panel as electronic device, Z . . . display area, 1 . . . display device and car use display device, 3 . . . control unit, 4*a* . . . substrate, 8 . . . color pixel as pixel, 9R, 9G, 9B . . . organic electroluminescence element as light emitting element, 11 . . . data line driver circuit as control means, 23 . . . current detection circuit as drive current detection means, 25 . . . reference voltage generation circuit as luminance control means, 26 . . . panel control circuit as comparison means, 27 . . . image processing circuit as data signal supply means.

The invention claimed is:

1. A display method of displaying based on image data, a first luminance image on a display area where pixels are arranged in a matrix including light emitting devices located at positions corresponding to intersections of a plurality of scanning lines and a plurality of data lines on a substrate by appropriately driving the respective pixels, comprising:

detecting a drive current of the respective pixels;

comparing detected current value of the drive current of the respective pixels to a previously set value of the drive current; and switching an image being displayed on the display from the first luminance image to a second luminance image that is different from the first image when the drive current is greater than the previously set value of the drive current.

2. The display method according to claim 1, wherein:

the first luminance image is a standard luminance image;

the second luminance image is a high luminance image in which the respective pixels used for the second image have a higher luminance than pixels used for the first image; and when the drive current of the pixels for the standard luminance image becomes higher than a previously set value due to outside light entering the display area, the image on the display area is switched from the standard luminance image to the high luminance image.

3. The display method according to claim 2, wherein when a drive current for the standard luminance image is higher than a previously set value, supplying high luminance image data for causing the light emitting devices to emit with higher luminance than the luminance of image data for the standard luminance image.

4. The display method according to claim 1, wherein the image data is image data for displaying a still image on the display area.

5. The display method according claim 2, wherein:

the display device is a display device for use in a car; and the standard luminance image is a meter image.

6. A display device for displaying based on image data, a first luminance image on a display area where pixels are arranged in a matrix including light emitting devices located at positions corresponding to intersections of a plurality of scanning lines and a plurality of data lines on a substrate by appropriately driving the respective pixels, comprising:

a drive current detection means for detecting a drive current of the pixels;

a luminance control means for generating and outputting a first luminance control signal for causing the respective pixels to emit light with a first luminance to display the first luminance image and a second luminance control signal for causing the respective pixels to emit light with a luminance different from a luminance during the display of the first luminance image;

a comparison means for comparing the detected drive current with a previously set value of the drive current; and a control means that outputs the first luminance control signal when the drive current is less than the previously set value of the drive current and the second luminance control signal when the drive current is greater than the previously set value of the drive current.

7. The display device according to claim 6, wherein the drive current detection means detects a drive current of the pixels caused by outside light entering the display area.

8. The display device according to claim 7, wherein:

the luminance control means is a data signal supply means for generating and outputting a data signal to be supplied to the respective pixels based on the image data; and the data signal supply means outputs, when the drive current for the first luminance image is equal to or higher than the previously set value, the second luminance control signal corresponding to high luminance image data for causing the light emitting device to emit light with a luminance higher than the luminance of the first luminance image.

9. The display device according to claim 6, wherein:

the display device is a display device for use in a car; and the first luminance image is a meter image.

10. The display device according to claim 6 wherein the light emitting device comprises an electroluminescence element.

11. The display device according to claim 10, wherein the electroluminescence element comprises an organic electroluminescence element.

12. An electronic apparatus comprising the display device according to claim 6.

* * * * *